US006898875B2

(12) United States Patent
Ruff

(10) Patent No.: US 6,898,875 B2
(45) Date of Patent: May 31, 2005

(54) SHOE WITH DRAWER

(75) Inventor: Stephen M. Ruff, Oviedo, FL (US)

(73) Assignee: Kidsational, Inc., Savannah, GA (US)

( * ) Notice: Subject to any disclaimer, the term of this patent is extended or adjusted under 35 U.S.C. 154(b) by 0 days.

(21) Appl. No.: 10/625,599

(22) Filed: Jul. 24, 2003

(65) Prior Publication Data

US 2005/0016031 A1 Jan. 27, 2005

(51) Int. Cl.[7] ..... A43B 23/00
(52) U.S. Cl. ..... 36/136; 36/1
(58) Field of Search ..... 36/1, 132, 136; 312/270.1, 319.1, 319.3, 330.1, 348.3

(56) References Cited

U.S. PATENT DOCUMENTS 32,490 A * 6/1861 Towers ..... 36/1
922,499 A * 5/1909 Molitor ..... 369/1
1,085,254 A * 1/1914 Halley ..... 36/1
1,396,378 A * 11/1921 Guido ..... 312/319.1
2,478,411 A * 8/1949 Martin ..... 36/1
2,507,991 A * 5/1950 Neal ..... 36/1
2,840,437 A * 6/1958 Hyam ..... 312/319.1
2,904,901 A * 9/1959 Murray ..... 36/1
5,231,776 A * 8/1993 Wagner ..... 36/114
5,692,324 A * 12/1997 Goldston et al. ..... 36/137
5,921,008 A 7/1999 Ruff
6,094,844 A 8/2000 Potts
6,243,974 B1 6/2001 Schaj
6,289,612 B1 9/2001 Kent

* cited by examiner

*Primary Examiner*—M. D. Patterson
(74) *Attorney, Agent, or Firm*—Birch, Stewart, Kolasch & Birch, LLP

(57) ABSTRACT

An article of footwear includes a sole portion; a second portion above the sole portion, the second portion including a compartment therein; and a drawer which is receivable within the compartment of the second portion and elastically attached to the article of footwear. The second portion is preferably a heel portion of the article of footwear, and the drawer is preferably engaged with the article of footwear by an elastic thread. The drawer may have an interior portion which is divided into a plurality of compartments.

17 Claims, 3 Drawing Sheets

SHOE WITH DRAWER

BACKGROUND OF THE INVENTION

1. Field of the Invention

The present invention is directed to a shoe, sandal or other footwear having a slidable drawer on a heel portion thereof, and more particularly to a shoe having a slidable drawer which is attached elastically to the inside of the heel portion of the shoe.

2. Description of the Related Art

Persons who engage in physical or athletic activities either indoors or outdoors often carry keys, coins, cards and other small items. During such activities, these items can easily fall out and become lost if the persons keep them in the pockets of their shirts or pants. Even if the pockets are equipped with zippers to keep the items from falling out, it may be uncomfortable to keep the items in those pockets. This can make it needlessly difficult for the persons to keep track of the items.

One solution to this problem is to keep such items in shoes instead. In recent years, shoes have been developed which contain storage compartments for holding small objects. Such a shoe is disclosed, for example, in U.S. Pat. No. 5,921,008, issued on Jul. 13, 1999, to Ruff, which is incorporated herein by reference. As disclosed therein, an athletic shoe includes a storage compartment in the heel of the shoe for slidably receiving a drawer, which is secured to the shoe using a strap and a hook-and-loop fastener. The drawer is opened by unfastening the strap and pulling out the drawer using a handle portion attached to the drawer.

However, the shoe disclosed in U.S. Pat. No. 5,921,008 has several disadvantages. The hook-and-loop fastener is not always able to withstand the impact to the shoe when the wearer engages in activities such as running, jumping or playing kick ball, for example. As a result, the strap holding in the drawer can become detached during these activities, thereby causing the drawer to fall out of the shoe and any items in the drawer to become lost. Also, it is inconvenient for the wearer of the shoe to have to unfasten the strap, pull out the drawer, re-insert the drawer and re-fasten the strap each time the wearer desires to store items in the drawer. Finally, it may not be esthetically pleasing to the wearer to have a strap attached across the entire heel portion of the shoe.

SUMMARY OF THE INVENTION

Accordingly, the present invention is directed to a shoe with a drawer that substantially obviates one or more problems due to the limitations and disadvantages of the related art.

An object of the present invention is to provide a shoe having a drawer that does not detach completely from the shoe.

Another object of the present invention is to provide a shoe having a drawer than can easily be disengaged from and re-engaged in the body of the shoe.

Yet another object of the present invention is to provide a shoe having a drawer with the ability to store different items in different compartments of the drawer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

In order to achieve these and other objects, the present invention in one aspect provides an article of footwear, including a sole portion; a second portion above the sole portion, the second portion including a compartment therein; and a drawer which is receivable within the compartment of the second portion and elastically attached to the article of footwear.

Another aspect of the present invention provides an article of footwear, including a sole portion; a heel portion above the sole portion, the heel portion including a compartment therein; and a drawer which is receivable within the compartment of the heel portion and attached to the article of footwear by an elastic thread.

Yet another aspect of the present invention provides an article of footwear, including a sole portion; a second portion above the sole portion, the second portion including a compartment therein; and a drawer which is receivable within the compartment of the second portion and elastically attached to the article of footwear, wherein the drawer has an interior portion that is divided into a plurality of compartments.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE PREFERRED EMBODIMENTS

Figure 1:
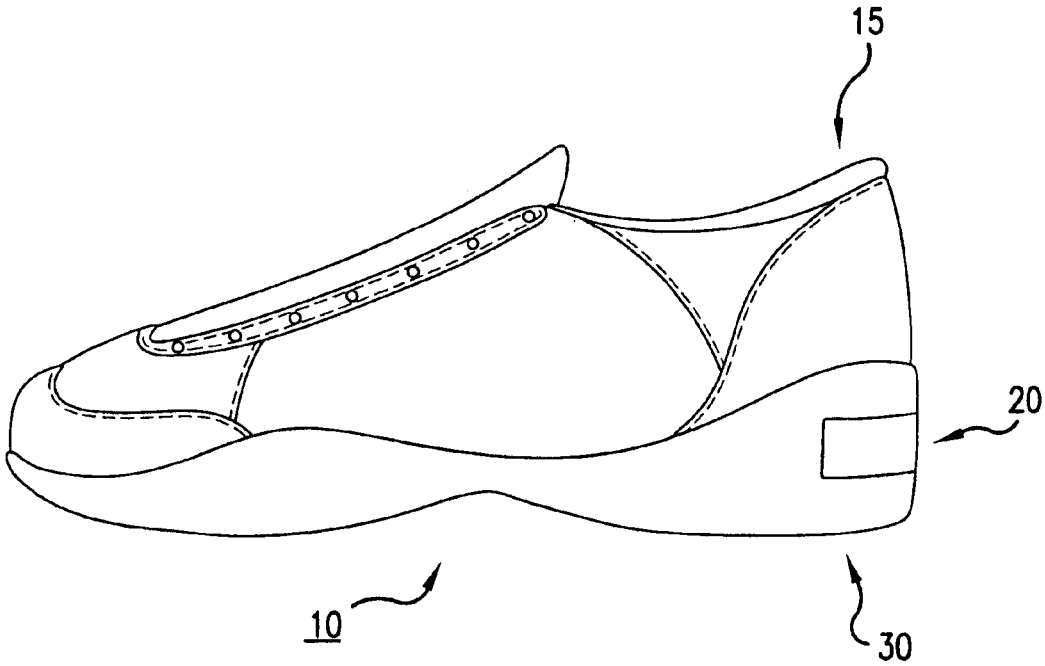
FIG. 1 illustrates a side view of a shoe having a drawer in accordance with a first embodiment of the present invention.

Referring now to the drawings, wherein like reference numerals designate identical or corresponding parts throughout the several views, FIG. 1 illustrates a side view of a shoe having a drawer in accordance with a first embodiment of the present invention. The shoe 10 includes a heel portion 15 and a sole 30. As shown, a drawer 20 is engaged on the heel portion 15 in a location above the sole 30. It is to be understood, however, the placement of the drawer 20 is not limited to the heel portion 15 of the shoe 10. The drawer 20 may alternatively be placed on other portions such as on side portions of the shoe 10. Moreover, the width or height of the drawer can be formed relatively large or small in accordance with the preferences of the wearer.

Figure 2:
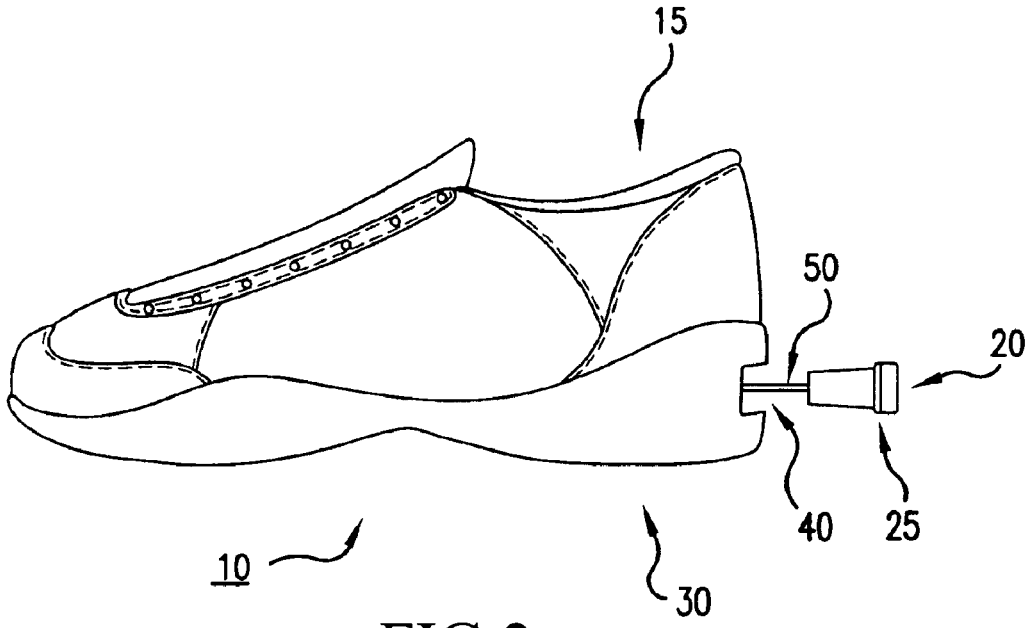
FIG. 2 illustrates a side view of the shoe in FIG. 1 with the drawer pulled out of the shoe in accordance with the first embodiment of the present invention.

FIG. 2 illustrates a side view of the shoe in FIG. 1 with the drawer pulled out of the shoe in accordance with the first embodiment of the present invention. The drawer 20 is engaged in a storage compartment 40 formed over the sole 30. The width and height of the drawer 20 may gradually decrease in the direction of the interior of the storage compartment 40. The drawer 20 is attached to the shoe 10 by a string or thread 50, which is preferably elastic. The thread 50 may be anchored through an opening on an interior wall of the storage compartment 40 or at a location behind the wall of the storage compartment 40.

The anchor of the thread 50 can be in any form, such as tying the thread 50 to a support behind the wall of the storage compartment. However, other ways of the attaching the thread 50 will be readily apparent to those having ordinary skill in the art. The drawer 20 is securely engaged inside the storage compartment 40 by the elastic force of the thread 50 until the wearer desires to disengage the drawer 20. When the wearer of the shoe 10 desires to disengage the drawer 20, the wearer simply pulls a front plate 25 of the drawer 20 against the elastic force of the thread 50.

Figure 3:
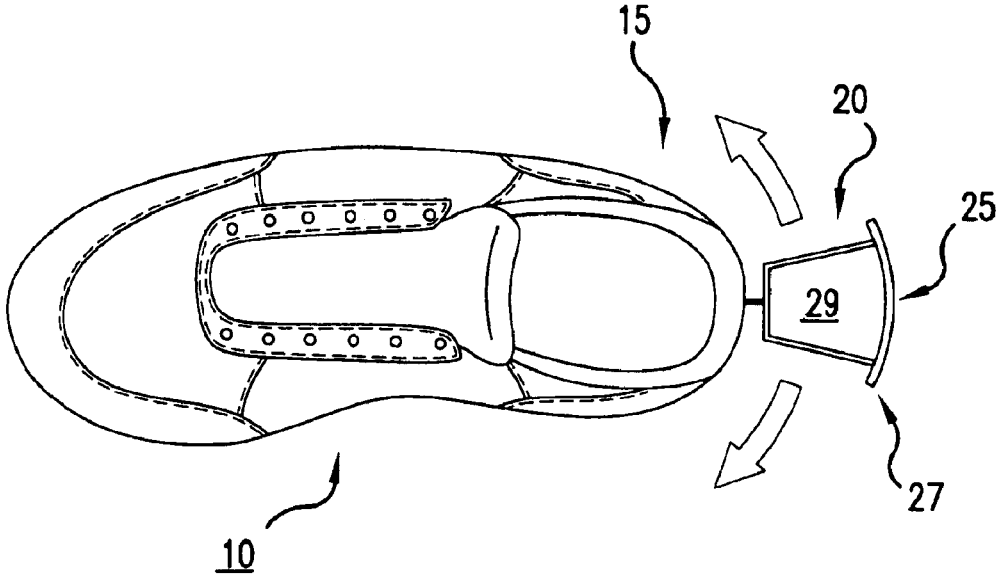
FIG. 3 illustrates a top view of the shoe in FIG. 1 with the drawer pulled out of the shoe in accordance with the first embodiment of the present invention.

FIG. 3 illustrates a top view of the shoe in FIG. 1 with the drawer pulled out of the shoe in accordance with the first embodiment of the present invention. The drawer 20 includes an interior portion 29 for storing items desired by the wearer. The front plate 25 of the drawer 20 may be concave in shape to fit snugly on the heel portion 15. Of course, the front plate 25 may have other alternative shapes readily apparent to those having ordinary skill in the art to fit the contours of any other portion of the shoe 10 on which the drawer 20 is formed. The front plate 25 includes end portions 27, which fit on the exterior wall of the heel portion 15 when the drawer 20 is engaged in the storage compartment 40. The wearer pulls on the end portions 27 using the thumb and index finger, for example, to disengage the drawer 20 from the storage compartment 40. Because the drawer 20 is attached to the shoe 10 by the thread 50, the drawer 20 can be swung to the left or right, as shown by the thick arrows in FIG. 3, so that the wearer can conveniently insert items in the drawer 20.

Figure 4:
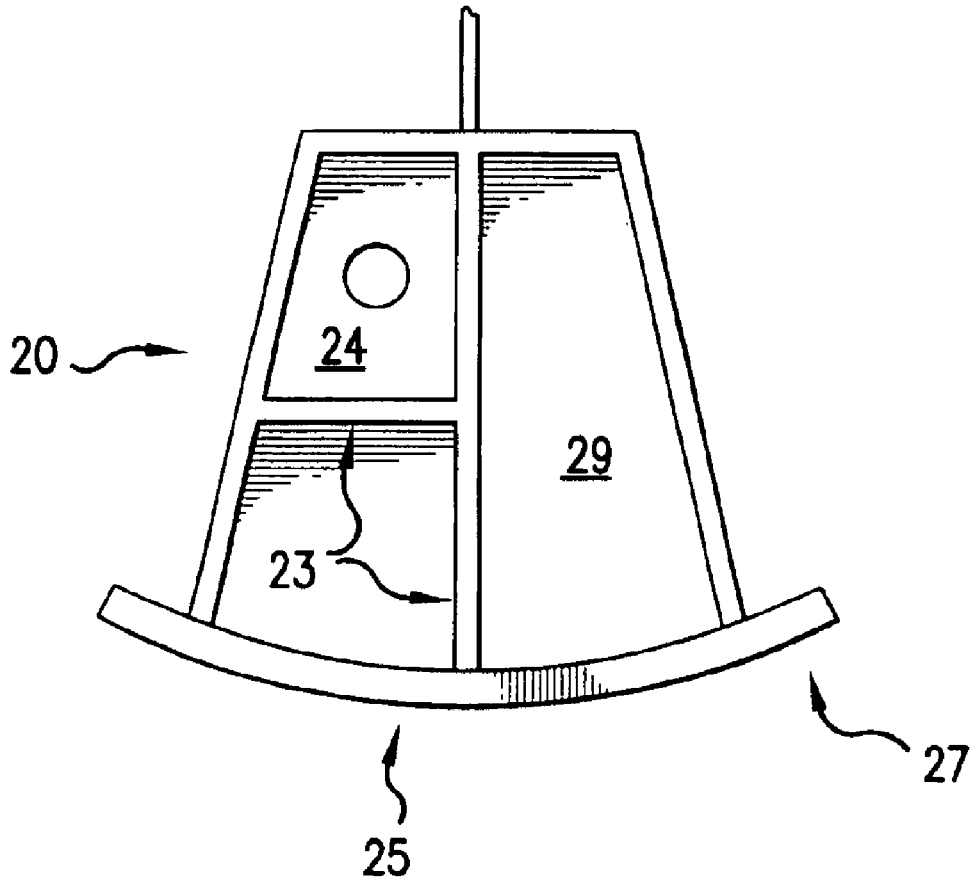
FIG. 4 illustrates a top view of the drawer of the shoe in FIG. 1 in accordance with a second embodiment of the present invention.

FIG. 4 illustrates a top view of the drawer of the shoe in FIG. 1 in accordance with a second embodiment of the present invention. The interior portion 29 of the drawer 20 may include walls 23, which separate the interior portion 29 into compartments 24 so that different items can be stored in different compartments 24. For example, keys can be stored in one compartment and coins can be stored in another.

The walls of the drawer 20 engage closely with the interior walls of the storage compartment 40 to ensure that items in the drawer 20 remain within the drawer during movement of the shoe 10. However, the interior portion 29 of the first embodiment or one or more of the compartments 24 of the interior portion 29 of the second embodiment may have a flap with a button or zipper to tightly secure small items so that they do not move around in the drawer 20.

Accordingly, the present invention provides the advantage of a shoe having a drawer that is more securely engaged to the shoe so that it does not fall out during rigorous activity by the wearer. The wearer can easily disengage the drawer from the shoe by a single pull of the front plate of the drawer. The drawer can be swung to the left or right when it is disengaged, and contains different compartments for storing different items. Finally, the wearer can simply release the drawer and let it re-engage with the shoe to securely store the items.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An article of footwear, comprising:

a sole portion;

a second portion above the sole portion, the second portion including a compartment therein; and a drawer which is receivable within the compartment of the second portion and elastically attached to the article of footwear by an elastic thread connected between the drawer and the compartment.

2. The article of footwear according to claim 1, wherein the second portion is a heel portion of the article of footwear.

3. The article of footwear according to claim 1, wherein the thread is anchored through an opening on an interior wall of the storage compartment or at a location behind the wall of the storage compartment.

4. The article of footwear according to claim 1, wherein the drawer includes a front plate with end portions that fit on an exterior wall of the second portion when the drawer is engaged with the compartment of the second portion.

5. The article of footwear according to claim 4, wherein the drawer is disengaged from the compartment of the second portion by pulling the end portions of the front plate.

6. The article of footwear according to claim 5, wherein the drawer can be swung sideways when the drawer is disengaged from the compartment of the second portion.

7. An article of footwear, comprising:

a sole portion;

a heel portion above the sole portion, the heel portion including a compartment therein; and a drawer which is receivable within the compartment of the heel portion and attached to the compartment by an elastic thread.

8. The article of footwear according to claim 7, wherein the thread is anchored through an opening on an interior wall of the storage compartment or at a location behind the wall of the storage compartment.

9. The article of footwear according to claim 7, wherein the drawer includes a front plate with end portions that fit on an exterior wall of the second portion when the drawer is engaged with the compartment of the second portion.

10. The article of footwear according to claim 9, wherein the drawer is disengaged from the compartment of the second portion by pulling the end portions of the front plate.

11. The article of footwear according to claim 10, wherein the drawer can be swung sideways when the drawer is disengaged from the compartment of the second portion.

12. The article of footwear according to claim 7, wherein at least one of a width and height of the drawer decreases gradually towards an interior of the compartment of the heel portion.

13. The article of footwear according to claim 9, wherein the front plate is formed having a concave shape.

14. An article of footwear, comprising:

a sole portion;

a second portion above the sole portion, the second portion including a compartment therein; and a drawer which is receivable within the compartment of the second portion and elastically attached to the compartment by an elastic thread, wherein the drawer has an interior portion that is divided into a plurality of compartments.

15. The article of footwear according to claim 14, wherein the second portion is a heel portion of the article of footwear.

16. The article of footwear according to claim 14, wherein the thread is anchored through an opening on an interior wall of the storage compartment or at a location behind the wall of the storage compartment.

17. The article of footwear according to claim 14, wherein the drawer includes a front plate with end portions that fit on an exterior wall of the second portion when the drawer is engaged with the compartment of the second portion.

* * * * *